United States Patent [19]

Murakami et al.

[11] 4,370,052

[45] Jan. 25, 1983

[54] COPYING APPARATUS WITH DETACHABLE SORTER

[75] Inventors: Katsumi Murakami, Kawasaki; Katsushi Furuichi, Yokohama; Toshio Honma, Tokyo, all of Japan

[73] Assignee: Canon Kabushiki Kaisha, Tokyo, Japan

[21] Appl. No.: 138,983

[22] Filed: Apr. 10, 1980

[30] Foreign Application Priority Data

Apr. 19, 1980 [JP] Japan ..... 55-48407
Apr. 19, 1980 [JP] Japan ..... 55-48408

[51] Int. Cl.[3] ..... G03G 15/00

[52] U.S. Cl. ..... 355/14 R; 271/288; 355/3 SH

[58] Field of Search ..... 355/14 R, 14 SH, 3 SH, 355/3 R, 16; 271/288, 289, 290

[56] References Cited

U.S. PATENT DOCUMENTS

| | | | |
|---|---|---|---|
| 3,709,485 | 1/1973 | Acquaviva | 271/290 |
| 3,709,492 | 1/1973 | Baker et al. | 355/14 SH |
| 3,845,949 | 11/1974 | Acquaviva et al. | 271/290 |
| 3,848,867 | 11/1974 | Johnson | 271/290 |
| 3,905,594 | 9/1975 | Davis | 271/290 |
| 4,012,032 | 3/1977 | Rogers | 271/290 |
| 4,200,386 | 4/1980 | Queener | 355/14 SH |

*Primary Examiner*—R. L. Moses
*Attorney, Agent, or Firm*—Fitzpatrick, Cella, Harper & Scinto

[57] ABSTRACT

A copying apparatus with a detachable sorter capable of detecting the receiving capacity of the sorter and controlling the function or display of the apparatus accordingly. Also the data concerning the sorter bins are manually set on the apparatus for controlling the function or display of the apparatus accordingly.

28 Claims, 26 Drawing Figures

| | 0 | 1 | 2 | 3 | 4 | 5 | 6 | 7 |
|---|---|---|---|---|---|---|---|---|
| 0 | | COUNTER WA(0) | | | | | WA(1) | |
| 1 | | | WA(4) | | | | WA(5) | |
| 2 | | | x'400' | x'300' | | | | |
| 3 | | | KEY INPUT (OUTLET) | (MAG.) | | | | |
| 4 | | | OUTLET | MAG. | | | | |
| 5 | | | DECK | D-L | | | | |
| 6 | | | NO PAPER | | | | | |
| 7 | | | | | | | | |
| 8 | ERROR FLAG | J1 1 | J1' 2 | J2 3 | J3 4 | J4 5 | JT 6 | J5 7 |
| 9 | | TH1 11 | | CWB 13 | STRD 14 | STRJ1 15 | STRJ2 16 | |
| A | | CP 21 | DHP 22 | OHP 23 | | RGP 25 | OBP 26 | RD1 27 |
| B | | M1 31 | M2 32 | M4 33 | M6 34 | FM1 35 | | |
| C | | HVTA 41 | HVTB 42 | HVTC 43 | HVTD1 44 | HVTD2 45 | HVTF 46 | HVTG1 47 |
| D | INSPECTION MODE DISPLAY (F) | (-) | | ERROR MODE DISPLAY (E) | | | | |
| E | | | | | | | | |
| F | | | | | | | | |

FIG. 4-1A

| 8 | 9 | A | B | C | D | E | F |
|---|---|---|---|---|---|---|---|
| | | WA(2) | | | | WA(3) | |
| KEY INPUT | | WA(6) | | KEY INPUT | | WA(7) | |
| | | SET COUNTER 0 | 0 | 1 | | | |
| | | COPY COUNTER 0 | 0 | 0 | | | |
| | BIN DES. FLAG | START BIN POS. 0 | 1 | 1 | | | |
| | | | SORT | | | | |
| | | | | | | | |
| | | | | | | | |
| | | | | | | | |
| TE 18 | SE 19 | | | | | | |
| RD0.7 28 | RD0.6 29 | | | | | | |
| | | | | | | | |
| HVTG2 48 | | | | | | | |
| | | | | | | | |
| | | | | | | | |
| | | | | | | | |

FIG. 4-1B

COPYING APPARATUS WITH DETACHABLE SORTER

BACKGROUND OF THE INVENTION

1. Field of the Invention

The present invention relates to a feed control apparatus for use for example in a copier having plural bins for receiving copy sheets.

2. Description of the Prior Art

There is already known a copier equipped with so-called sorter for classified storage of copy sheets. The sorter functions, in case of multiple copies from a same original, of storing one copy in each of plural storage bins.

In such conventional copier, in case the number of copies exceeds that of the storage bins, the overflowing copies are ejected onto a separate tray or stored into the last storage bin. In such case manual sorting is required for those copies ejected onto the tray or stored in the last storage bin, and the advantage resulting from the use of sorter is significantly reduced.

Also simple distribution of the copies to the last storage bin in such conventional copier may eventually result in copy distribution into the bins which are not usable because of copy sheets remaining in such being for some reason.

SUMMARY OF THE INVENTION

The object of the present invention is to provide a copier or the like allowing efficient distribution of a large amount of copies without the above-explained drawbacks and thus enabling extremely easy copying operation.

Another object of the present invention is to provide a copying apparatus capable of preventing the inconveniences resulting from simple distribution of copies in all the storage bins.

Still another object of the present invention is to provide a copying apparatus capable of controlling the function of or performing display on the apparatus in response to the receiving capacity or last bin position manually selected in advance of a storage unit having plural storage bins (hereinafter referred to as sorter).

Still another object of the present invention is to provide a copying apparatus capable of detecting the receiving capacity of the sorter in advance and controlling the function of or performing display on the apparatus accordingly.

Still another object of the present invention is to provide a copying apparatus allowing connection of plural sorters which are respectively provided means for calculating the total number of storage bins thereby allowing to transmit said total number of bins in a simple manner.

Still another object of the present invention is to provide a copying apparatus capable of starting sorting operation from a start bin to be selected in advance.

Still another object of the present invention is to provide a copying apparatus in which the sorter display unit is simplified by the common use thereof for the display for sorter selection and for sorter state.

BRIEF DESCRIPTION OF THE DRAWINGS

FIGS. 3-1, 3-1A, 3-1B, 3-1C, 3-2, 3-3 and 3-4 are circuit diagrams for controlling the function of said copier;

FIGS. 4-1, 4-1A, 4-1B and 4-2 are schematic views of memory areas for use in the circuit shown in FIG. 3-1;

FIGS. 5-1, 5-2, 5-3, 5-3A, 5-3B, 5-4, 5-5 are flow charts showing the control procedure in said circuits;

DETAILED DESCRIPTION OF THE PREFERRED EMBODIMENTS

Figure 1:
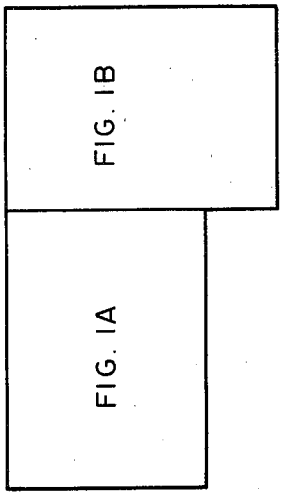
FIGS. 1 1A, 1B are cross-sectional views of a copier with sorter in which the present invention is applicable.

Now there will be explained an embodiment of the present invention while making reference to FIG. 1, in which shown are a copier C, a first sorter A detachably connected to said copier, a second sorter B detachably connected to said first sorter A, a photosensitive screen 1 as detailedly disclosed in the Japanese Patent Laid-Open Sho No. 50-19455, a primary corona charger 2, a secondary corona charger 3, a lamp 4, an original support plate 5, a modulating corona charger 6, an insulating drum 7, a developing unit 8, a feed roller 9 for feeding a transfer sheet 10, a transfer charger 11, a conveyor belt 12, a fixing roller 13, a tray 14 and eleven bins 20 in each sorter.

An original placed on the original support plate 5 is subjected to slit exposure by the displacement of the lamp 4 and a mirror 15, and the so-called three-layered screen 1 maintained in rotation and charged by the primary charger 2 in advance is exposed to the light from said original simultaneously with the discharge from the secondary charger to form an electrostatic latent image. Said primary latent image is transferred as the secondary electrostatic image on the insulating drum 7 by the modulating charger 6, and said secondary image is developed with a toner in the developing unit 8. The toner image thus obtained is transferred onto a transfer sheet supplied from a cassette 52 or a lift deck 53 by means of the transfer charger 11, said sheet being ejected to the sorter or to the tray 14 after fixing treatment by the heat rollers 13. Since the primary latent image is not dissipated after the formation of the secondary latent image, the screen 1 is further rotated to generate secondary latent images in succession by means of the charger 6 and the transfer sheets are fed in succession to repeat the steps of image transfer, fixing and ejection by the desired number of times. In case said desired number exceeds the number of secondary images obtainable from a single primary image, the primary image is generated anew.

In FIG. 1 there are also shown a lamp 16 for eliminating the charge from the screen, a cleaning unit 17-1 for removing the toner from the insulating drum 7, and an AC corona discharger 17-2 for eliminating remaining charge from the insulating drum 7.

Figure 2:
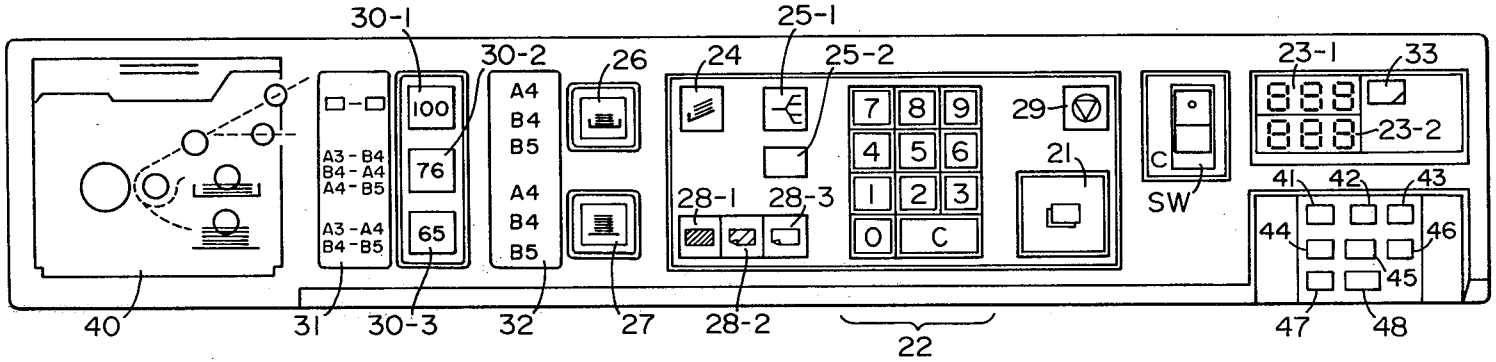
FIG. 2 is a plan view of the operating panel of said copier.
Figure 1A:
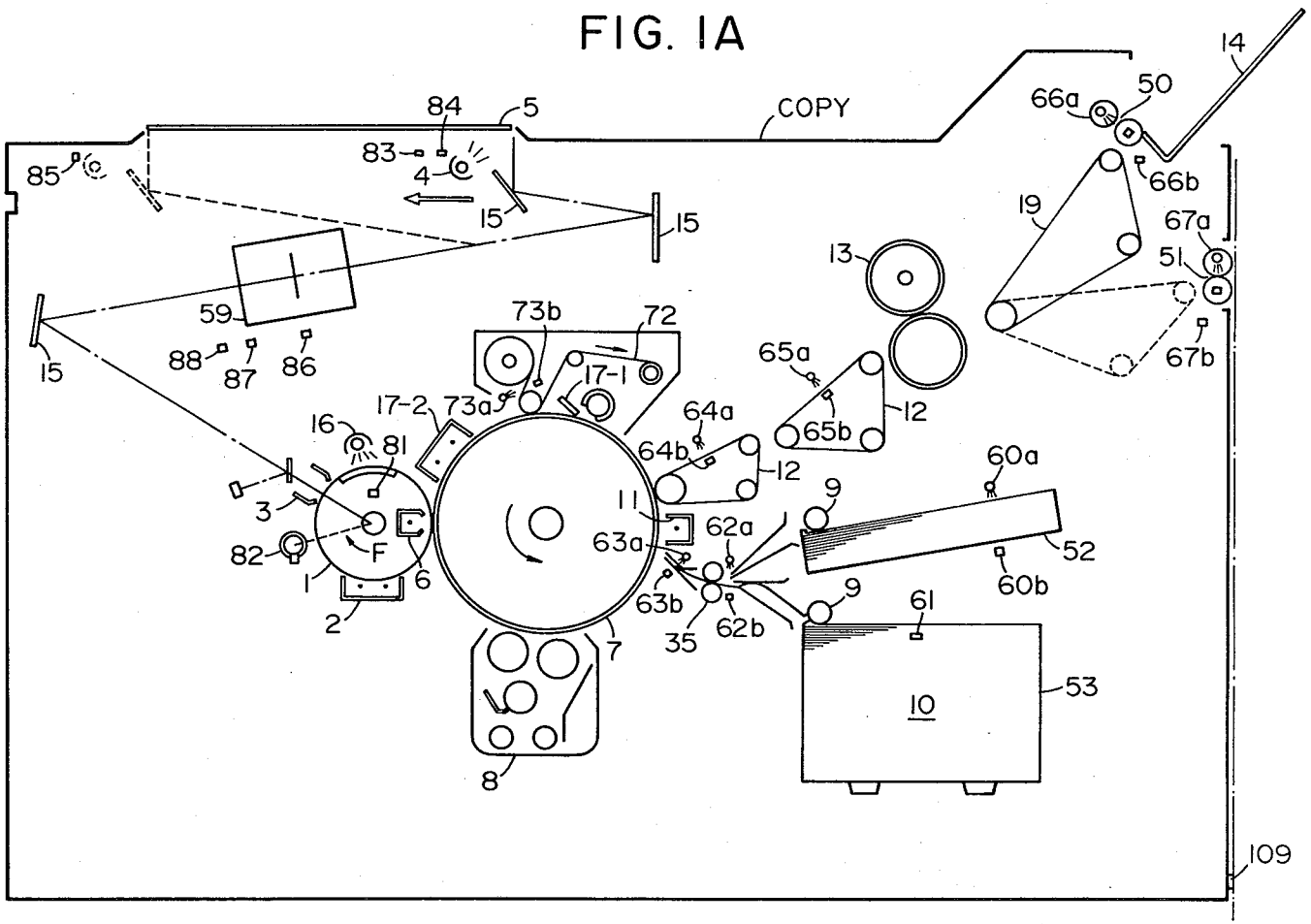
Figure 1B:
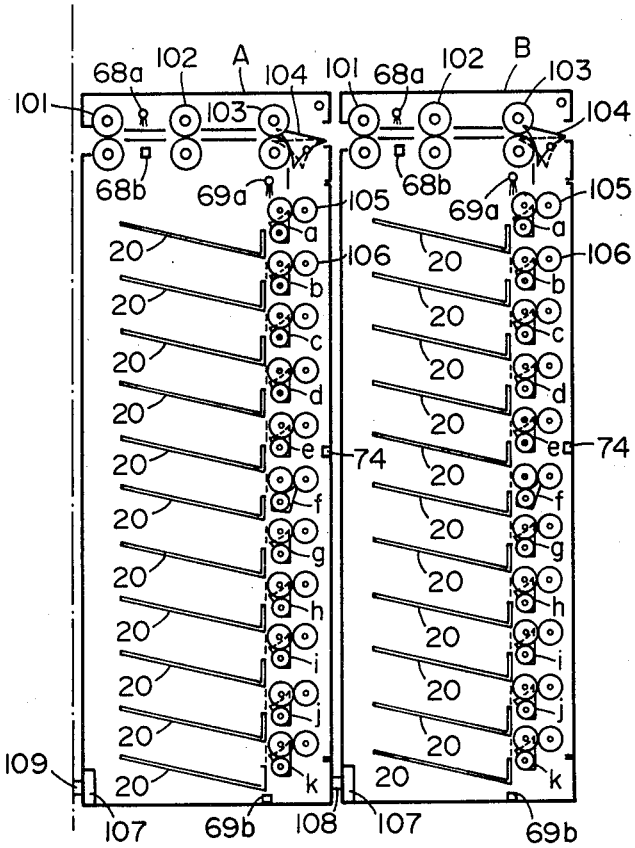

FIG. 2 shows the operating-display panel of the apparatus of FIG. 1, in which there are shown a main switch SW for power supply to the process loads and control circuit of the copier, a copy start key 21, a key 22 for setting copy number and selecting the sorting start position in the sorter, a set number display unit 23-1, a copy completion number display unit 23-2, said units being composed of 7-segment light-emitting diode elements, a tray select key 24, a sorter select key 25-1, said keys being lighted upon actuation to indicate whether the tray or sorter is selected for copy storage, and a switch 25-2 for selecting the position of the sorting start bin by means of ten numeral keys 22 in the sorter operation mode, said switch being lighted upon actuation to enable the entry of a number indicating the position of the sorting start bin by said ten keys 22. Upon re-actuation of said switch 25-2 the ten keys 22 function for selecting the copy number. Also shown are cassette/deck selection keys 26, 27 which are lighted upon actuation to indicate the selected key and to simultaneously display the paper size in the cassette or deck on the display unit 32, density selecting keys 28-1 to 28-3 which are lighted upon actuation to indicate a high, medium or low density respectively, a stop key 29 for interrupting the copying operation, and magnification selecting keys 30-1 to 30-3 for selecting an image magnification of 1, 0.76 or 0.65 times respectively which is displayed on a display unit 31. A clear key C is provided for changing the set number for the sorting start bin or the copy number. Said set numbers entered by said keys 22 are retained even after the completion of the copying cycle and can be cancelled by said clear key C. Thus the same number of copies can be obtained for the second original or thereafter by simply pressing the copy start button or by automatic original detection in case of an automobile original feeder.

In case the tray is selected the conveyor belt 19 shown in FIG. 1 is displaced to the unbroken line position to cause paper ejection through the ejection rollers 50. On the other hand when the sorter is selected, the belt 19 remains in the broken line position to cause paper ejection through the second ejection rollers 51.

The sorters A, B are respectively provided with entrance receiving rollers 101, feed rollers 102, exit feed rollers 103, a diverting claw 104, feed rollers 105, 106 to storage bins, storage bins 20, diverting claws a-k for guiding sheets into the bins 20, sensors 68*a*, 68*b* for detecting the receipt of a sheet by the sorter, and sensors 69*a*, 69*b* for detecting the receipt of a sheet by the bins. Each sorter is provided with eleven bins, but additional sorters C, D, . . . may be connected in a similar manner in case the required number of bins exceeds twenty-two.

The sorters function in the following manner. A copy sheet supplied to the sorter through the ejection rollers 51 is introduced into the sorter by the constantly rotating rollers 101, and, when the claw 104 is in the illustrated state, is supplied through the constantly rotating rollers 103 to the roller 105 of the first bin. As the claw a for the first bin is in a state "f" for the first sheet, said sheet is introduced into the first bin by the roller 105. Upon detection of the sheet receipt by the bin through the sensor 69*b*, said claw a is returned to the illustrated state. The second sheet introduced into the sorter A is supplied similarly to the bin roller 105, then to the roller 106 of the second bin and stored into the second bin by the claw b. In similar manner eleven sheets are stored down to the last bin. Upon detection of said storage the sorter claw 104 is shifted to the broken-lined position. Thus the twelfth sheet introduced into the sorter A is advanced through the rollers 102, 103 to the rollers 101 of the sorter B, in which the sheet storage is conducted in a similar manner as in the sorter A. The claws a-k of the sorter A are returned to the state f upon each sheet detection by the sensor 68*b* of the sorter A while those in the sorter B are returned to the state f upon similar detection by the sensor 68*b* of the sorter B.

Upon completion of copying cycles of a preselected number the claw 104 of the first sorter A is returned to the full-lined position to prepare for the storage of the copies from the second original. Upon initiation of the copying cycles in response to the actuation of the copy start key, the sorting operation is conducted by the sorters A, B in the same manner as explained in the foregoing.

In the foregoing operation, the claw 104 of the sorter A is shifted to the broken-lined position only when the selected copy number exceeds the number of bins in said sorter A and upon detection of the sheet storage in the last bin. In case the selected copy number exceeds the total number of bins in the sorters A, B, i.e. twenty-two in this case, the claw 104 of the sorter B is not shifted and the sorter select display is changed from continuous lighting to intermittent lighting of an interval of 0.5 seconds to give a warning to the operator. In this state the copying operation is not initiated even if the copy start key is actuated. It is also possible in this case to initiate the copying operation but to interrupt the copying operation to forbid the 23rd copying cycle. Furthermore it is possible to shift the conveyor belt 19 to the full-lined position in response to the passage of the 22nd sheet through the sensor 67 to eject the 23rd and succeeding sheets to the tray.

In a general manner, in case the number of sorters each having m bins is increased to n, the above-mentioned intermittent lighting and the prohibition of copy start are performed in response to the setting of a copy number exceeding $n \times m$ by the ten numeral keys.

The rearmost sorter, when it is connected to a preceding sorter, supplies a signal indicating the number of bins therein from a code generator 107 through a connecting line 108 to said preceding sorter, which in turn supplies a signal indicating the logic sum of the number of bins therein and said number of bins in said rearmost sorter to a further preceding sorter. In this manner the total number, $n \times m$, of the bins is supplied through a line 109 to the copier C.

The copier C stores said number in a memory and performs the above-mentioned control of intermittent light and copy operation through comparison of the copy number entered by the ten numeral keys with the number stored in the memory.

Figures 1, 3:
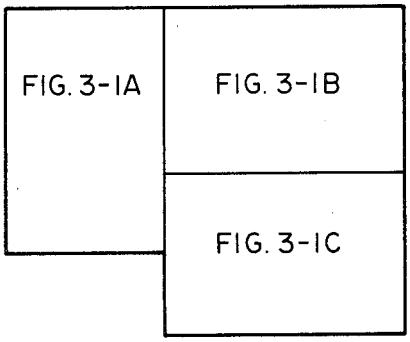
Figures 1A, 3:
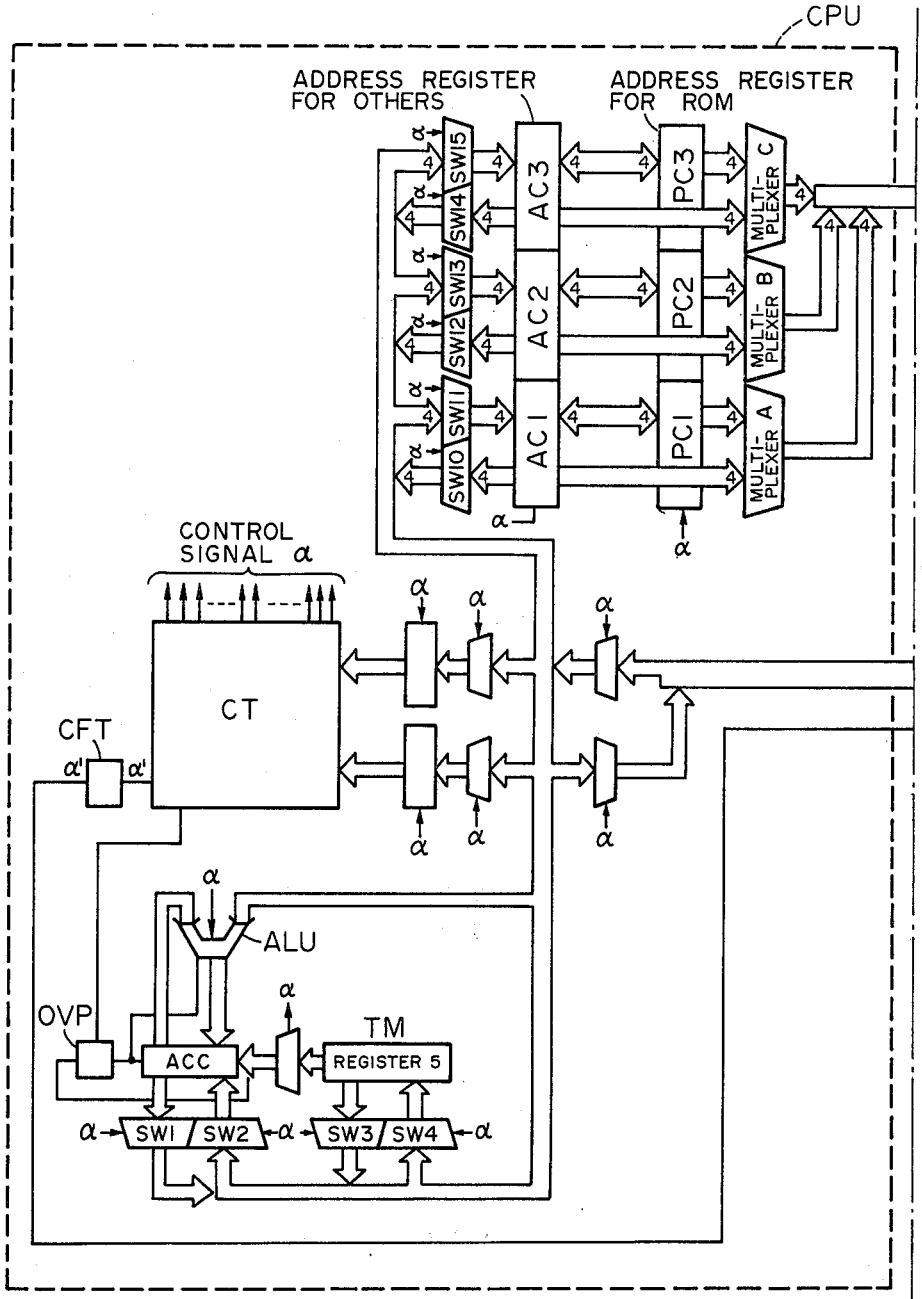
Figures 1B, 3:
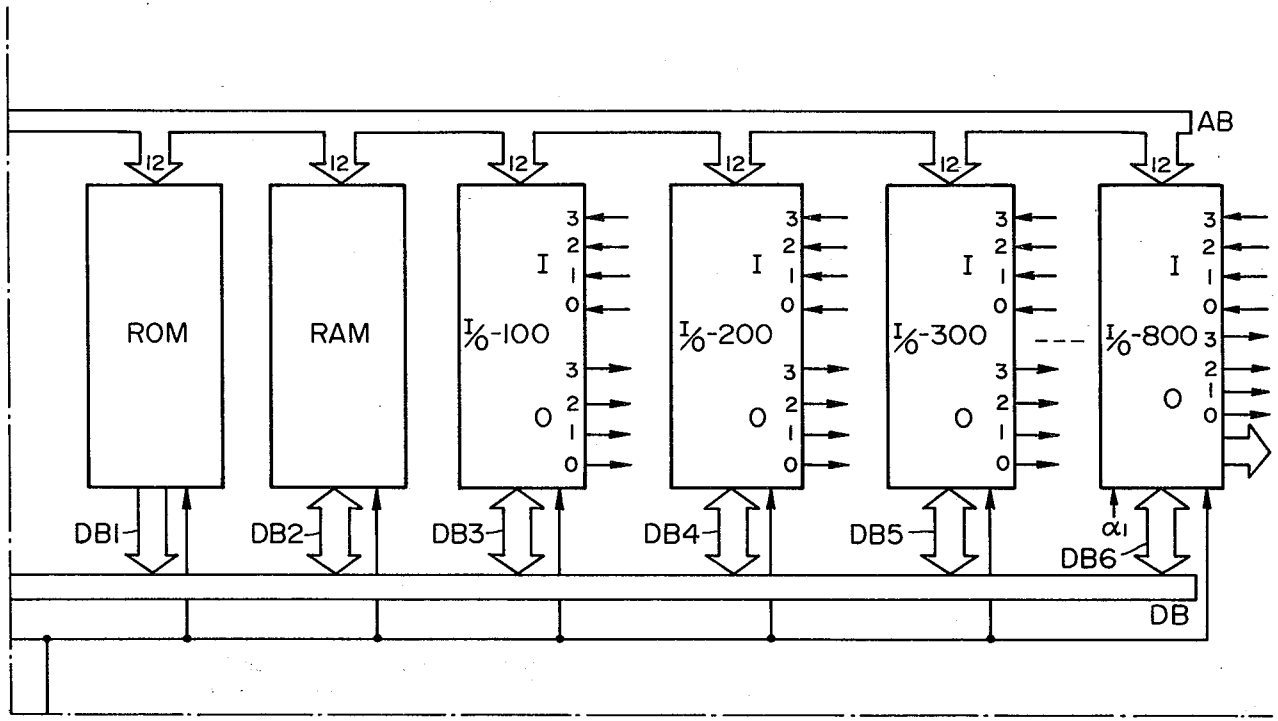
Figures 1C, 3:
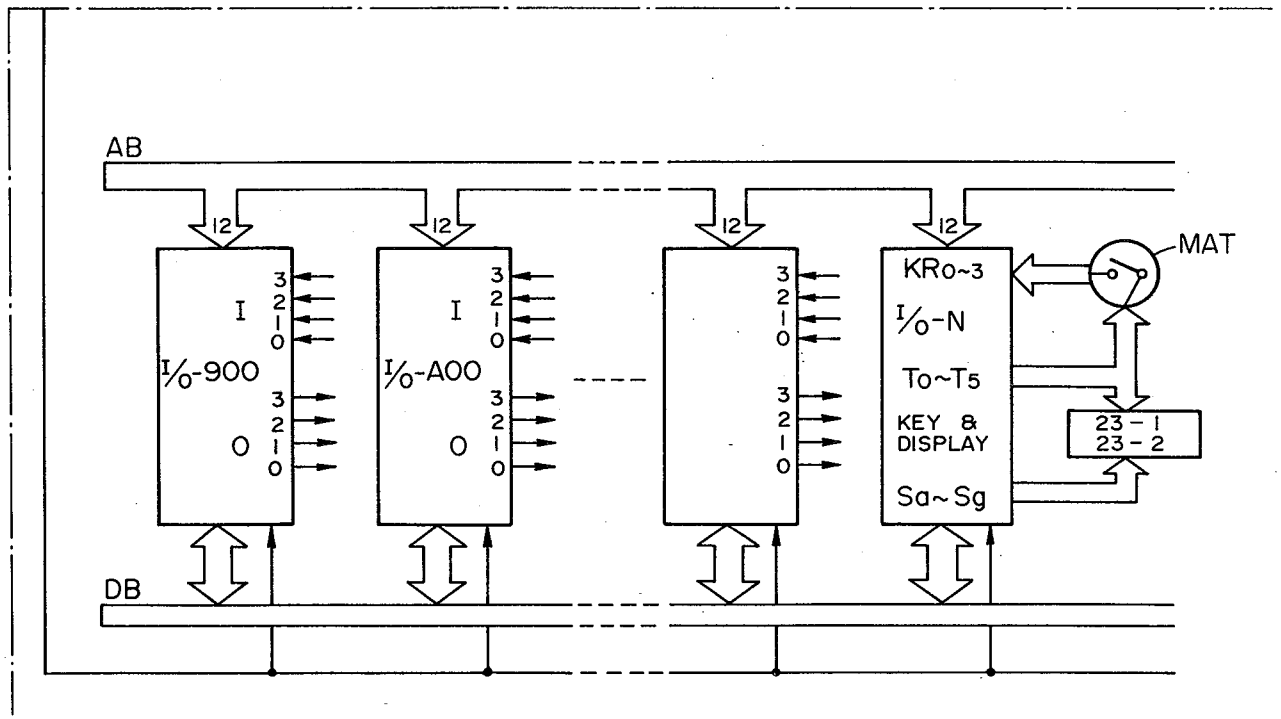
Figures 2, 3:
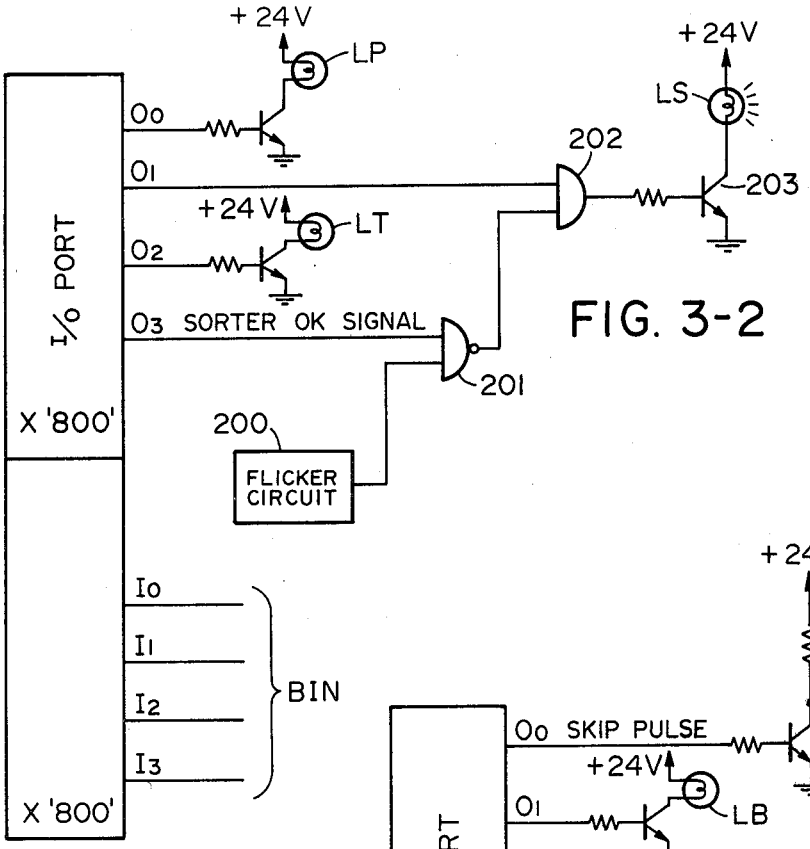
Figure 3:
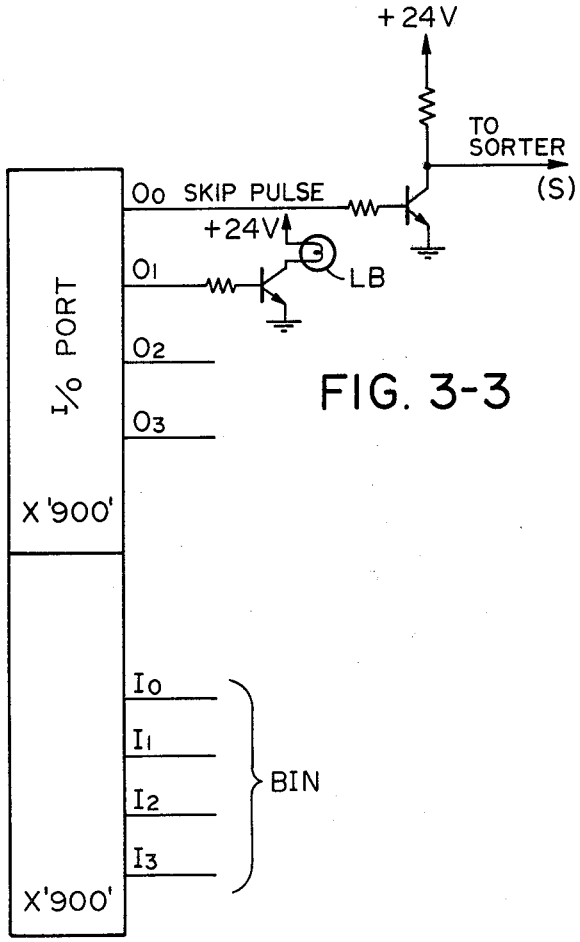
Figures 3, 4:
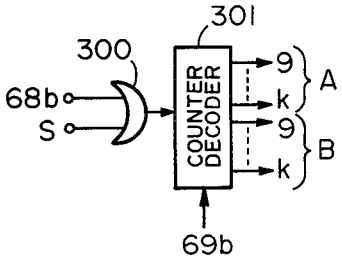
Figures 1, 4:
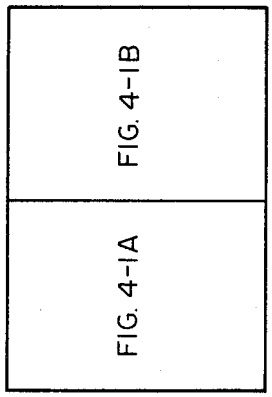
Figures 2, 4:
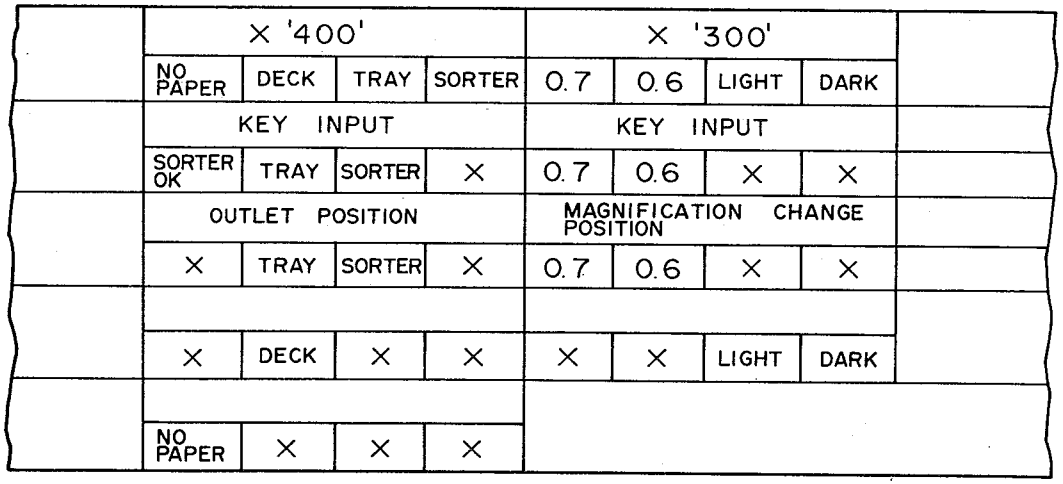

FIG. 3-1 shows an example of the control circuit utilizing a microprocessor, in which ROM is a read-only memory storing the programmed sequences of the key data entry, copying process etc. which are read in succession by a central processing unit CPU. RAM is random access memory for temporarily storing various data for copy number, ejection selection, sorter bin number etc. The area allocation in said memory is shown in FIGS. 4-1 and 4-2. The data entered from the ten numeral keys are stored in a SET area of the addresses X'02A'-X'02C'. The numeral data to be displayed on the segment display units 23-1, 23-2 are stored in the areas SET, COPY and read therefrom for display. Other key entry signals are temporarily stored in the addresses X'018' and X'01c' and thereafter transferred to various data areas. Upon actuation of the tray select key 24 or the sorter select key 25-1, data "0100" or "0010" are stored in the address X'032' according to which the conveyor belt 19 is shifted to select the sheet ejection path. The area X'042' stores the detection signal of the belt position after said belt shifting. The area SORT stores the total number of bins in the sorters. Upon connection of the sorters said number is automatically entered through the data line 109. Thus a number "22" is stored in case two sorters, having eleven bits each, are connected. Registers WA(0)–WA(7) function to store other temporary data.

Also the actuation of the bin select key 25-2 sets a flag in the address X'049'. The addresses X'04A'-X'04C' store data for selecting a bin position in response to the ten key entry, said data being released through an output port O of the address X'900' at the start of sorter operation to skip the corresponding bin.

Tab. 1 shows the relation between the key entry and the stored data.

TABLE 1

| KEY | (X'018) | KEY | (X'01c') |
|---|---|---|---|
| 0 | 0 | Magnification 1 | 0 |
| 1 | 1 | Magnification 0.7 | 1 |
| 2 | 2 | Magnification 0.6 | 2 |
| 3 | 3 | Density high | 3 |
| 4 | 4 | Density medium | 4 |
| 5 | 5 | Density low | 5 |
| 6 | 6 | Clear | 6 |
| 7 | 7 | Copy start | 7 |
| 8 | 8 | Cassette | 8 |
| 9 | 9 | Deck | 9 |
| No key | F | Sorter | A |
| | | Tray | B |
| | | Start bin position | C |
| | | No key | F |

A code F, or "0000" is stored in the absence of key entry.

I/O100-I/ON are input/output devices which, in response to the data input signals or no-paper signal etc. received according the program of the read-only memory ROM, generates drive signals for the main motor, high-voltage transformer, ejection shifting solenoid etc. I/ON is a known key-and-display chip for performing key entry and segment display, and is connected to a known matrix circuit MAT in which the line cross sections form closed circuits in response to key actuations and also to segment display units 23-1, 23-2 for releasing signals T0–T5 for the digit selection of said display units and for matrix circuit scanning, receiving key data signals KR0-3 and releasing segment signals Sa–Sg. The central processing unit generally comprises an arithmetic logic unit ALU, a logic control CT, a control unit OVF, registers and an accumulator. DB is an input/output data bus line, and AB is an address bus line for selecting I/O, ROM and RAM. In the present embodiment there is employed a microprocessor μCOM4 produced by Nippon Electric Co.

FIG. 3-2 shows an input/output unit I/O800 for driving the ejection select display and an input/output unit I/O900 for receiving the bin number of sorters, in which a tray lamp LT(24), a sorter lamp LS(25) and a no-paper warning lamp LP are connected to respective output ports. The output port O3 of the unit I/O800 releases the signal indicating that the sorter is ready and is also connected to the sorter lamp LS. There are also shown a circuit 200 for generating a series of pulses of a duty ratio of 1:0.5, a NAND gate 201 for receiving said sorter ready signal and said pulses, an AND gate 202 receiving the output from said NAND gate and the sorter display signal, and a driver 203 for driving the lamp LS. The output port 01 of the unit X'900' releases a signal for enabling sorter bin selection upon actuation of the key 25 for sorter bin selection and in response to the flag in the address X'049' and is connected to a bin selection lamp LB. The output port O0 releases, in response to the flag in the address X'049', pulses of a number corresponding to the data indicating the selected bin position stored in the aforementioned addresses X'04A'-X'04C'.

Figure 6:
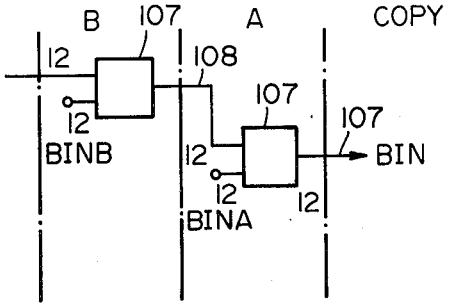
FIG. 6 is a circuit diagram showing the connection of a sorter.
Figure 7:
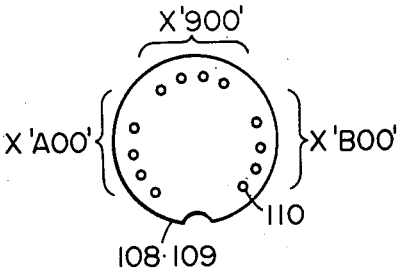
FIG. 7 is a cross-sectional view of a connector.
Figure 8:
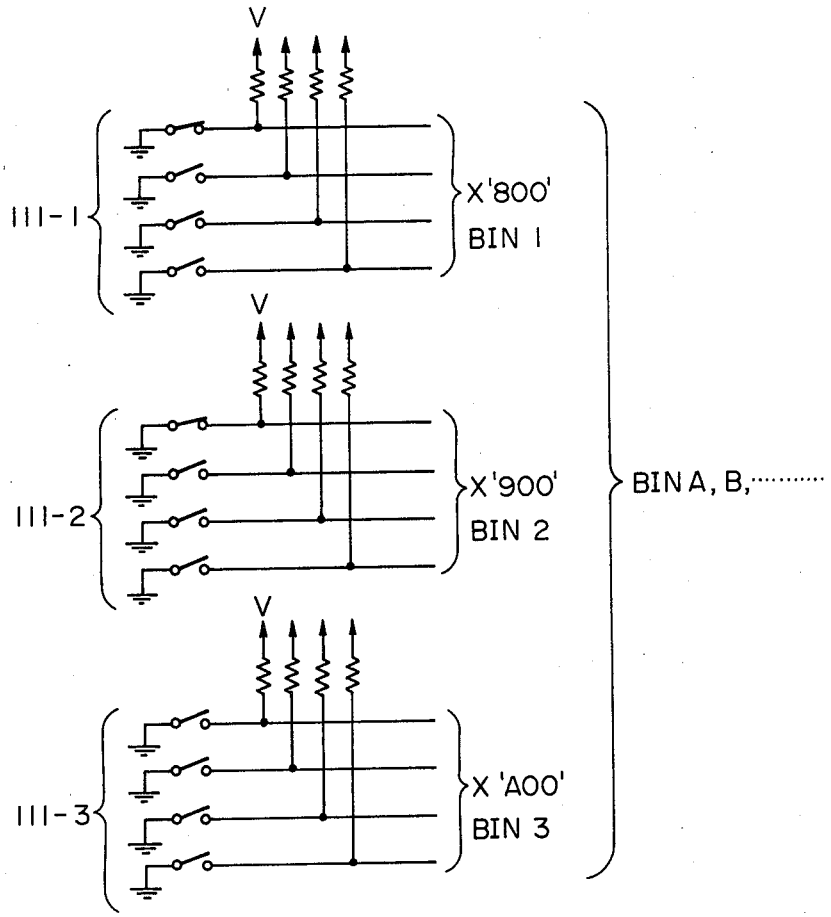
FIGS. 8 and 9 are circuit diagrams for generating a signal indicating the number of bins.

The input ports I0-I3 of X'800', X'900' and X'A00' (not shown) receive the signal BIN indicating the total number of bins in the sorters in the form of 3-digit code signals. As an example, in case of a bin number of 22, X'800', X'900' and X'A00' respectively receive "0100", "0100" and "0000". Said input ports are connected through the connector line 109 (FIG. 7) to the code generator 107 of the sorter. Said signals are easily obtainable since the sorters and copier are mutually connected through connector bins corresponding to such code bits. Said code generator 107 functions to add binary signals as explained in the foregoing and is connected as shown in FIG. 6, thereby transmitting the total bin number of the succeeding sorter or to the copier. Said 3-digit bin code is stored in the memory RAM. In FIG. 6 BINA and BINB are code signals indicating the bin number of each sorter and are respectively composed of the 1st digit signal BIN1, 2nd digit signal BIN2 and 3rd digit signal BIN3 determined by digital switches 111-1-111-3, wherein the illustrated switches correspond to a bin number of eleven in a sorter.

Said code signal may also be utilized for indicating an unusable bin, in which case the signal is generated in response to the detection of an unusable bin.

Figure 9:
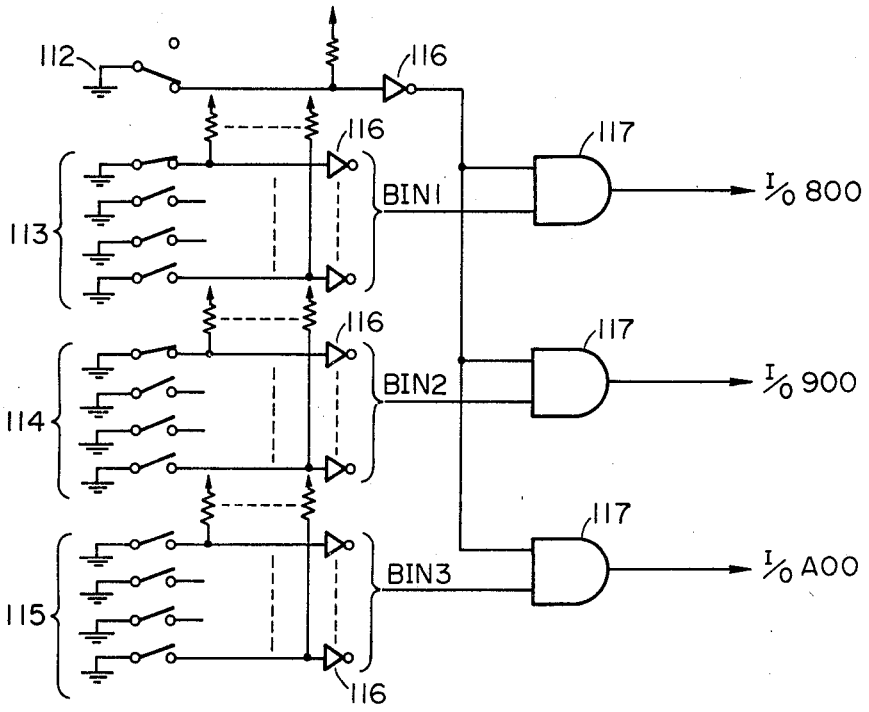

Also it is possible to position said switches on the copier itself or to enter the bin number through the ten numeral keys. FIG. 9 shows such example wherein BIN1-3 are connected to I/O800-I/OA00 to allow direct entry of the total number of usable bins in the sorters into the area SORT in the memory RAM. There are shown a microswitch 112 to be shifted to the contact S upon connection of the sorter to the copier, digital switches 113–115 provided in the operating panel of the copier and representing 22 bins in the illustrated state, an inverter 116 and an AND gate 117. Upon connection of a sorter the number code generated by said switches 113–115 is supplied through a gate 117 to the input/output ports. In this manner an arbitrary selection of bin number is rendered possible by means of said switches.

Such structure is advantageous in selecting an available number of bins for example by a service man in case some of the bins are not available for some reason.

Figures 1, 5:
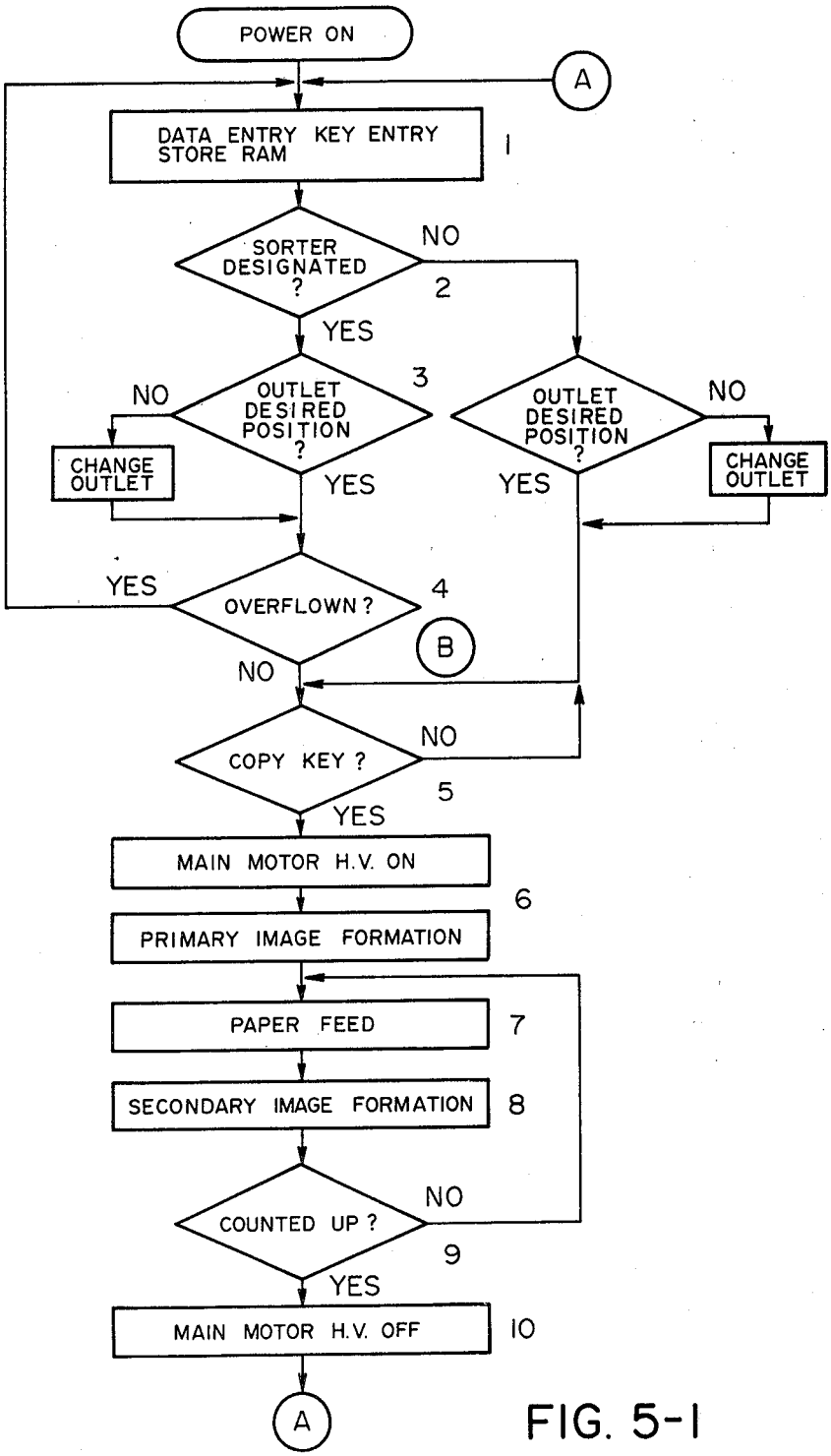
Figures 2, 5:
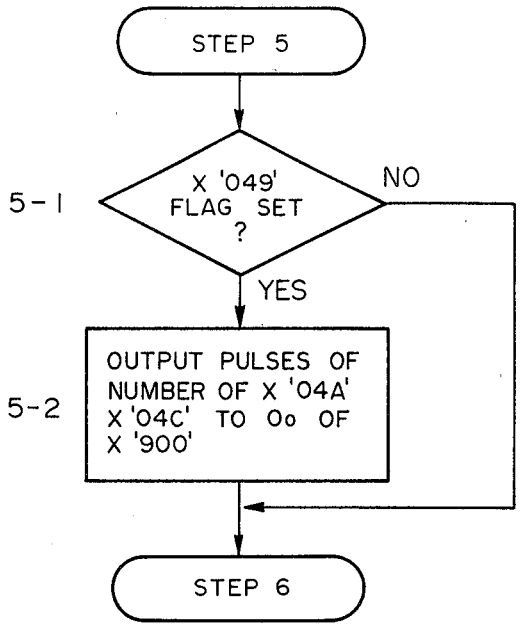
Figures 3, 5:
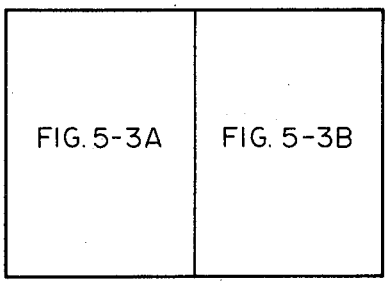
Figures 3A, 5:
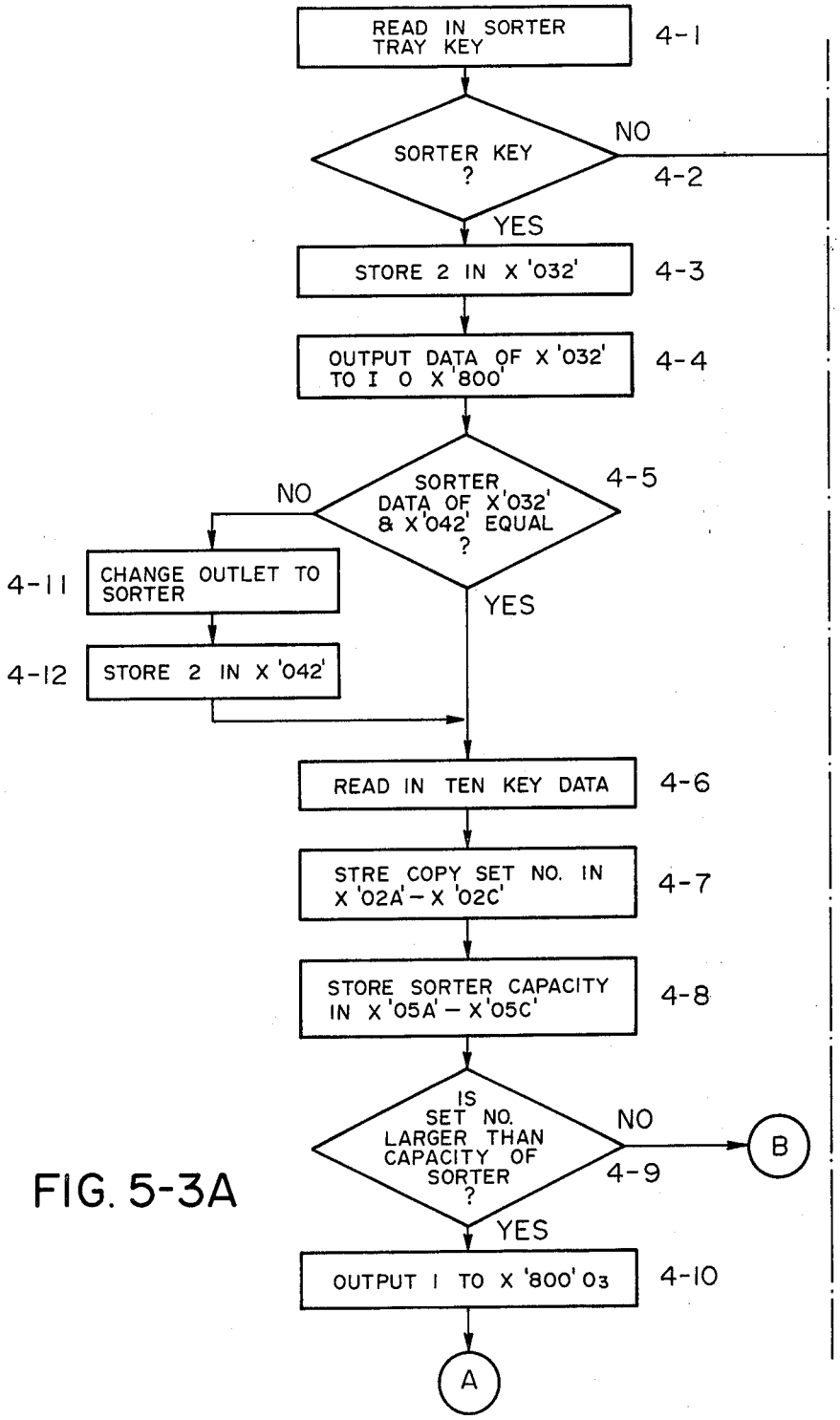
Figures 3B, 5:
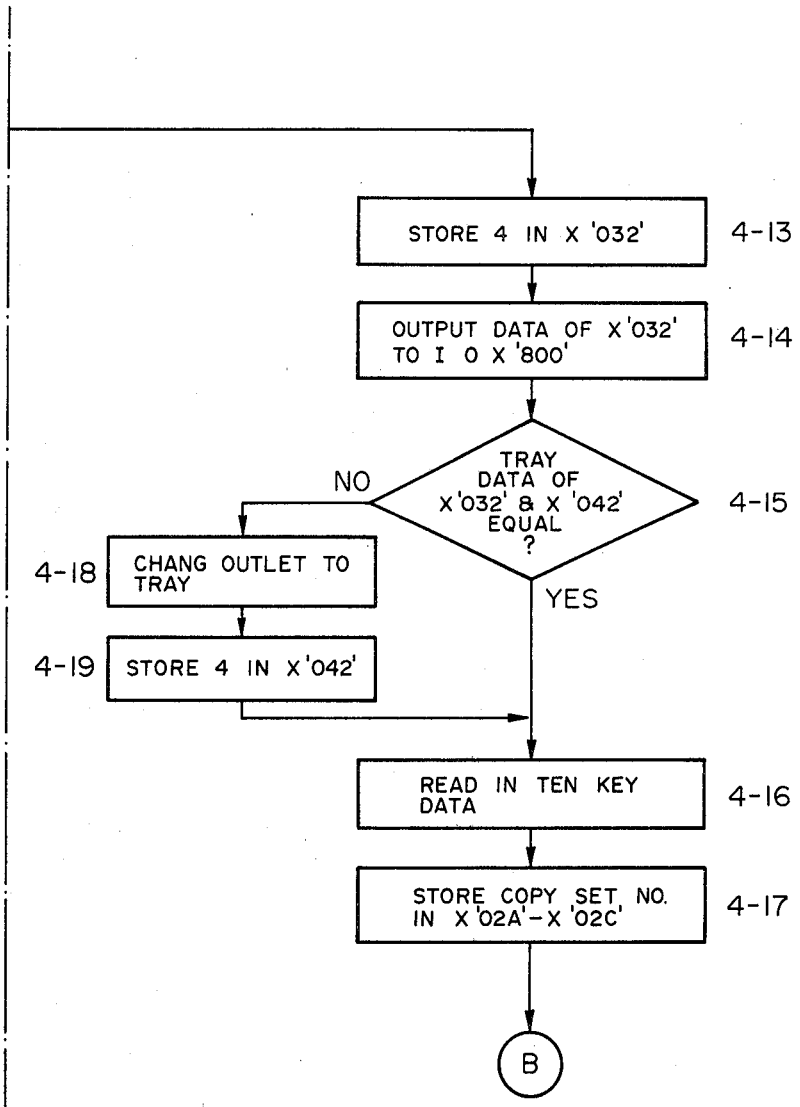
Figures 4, 5:
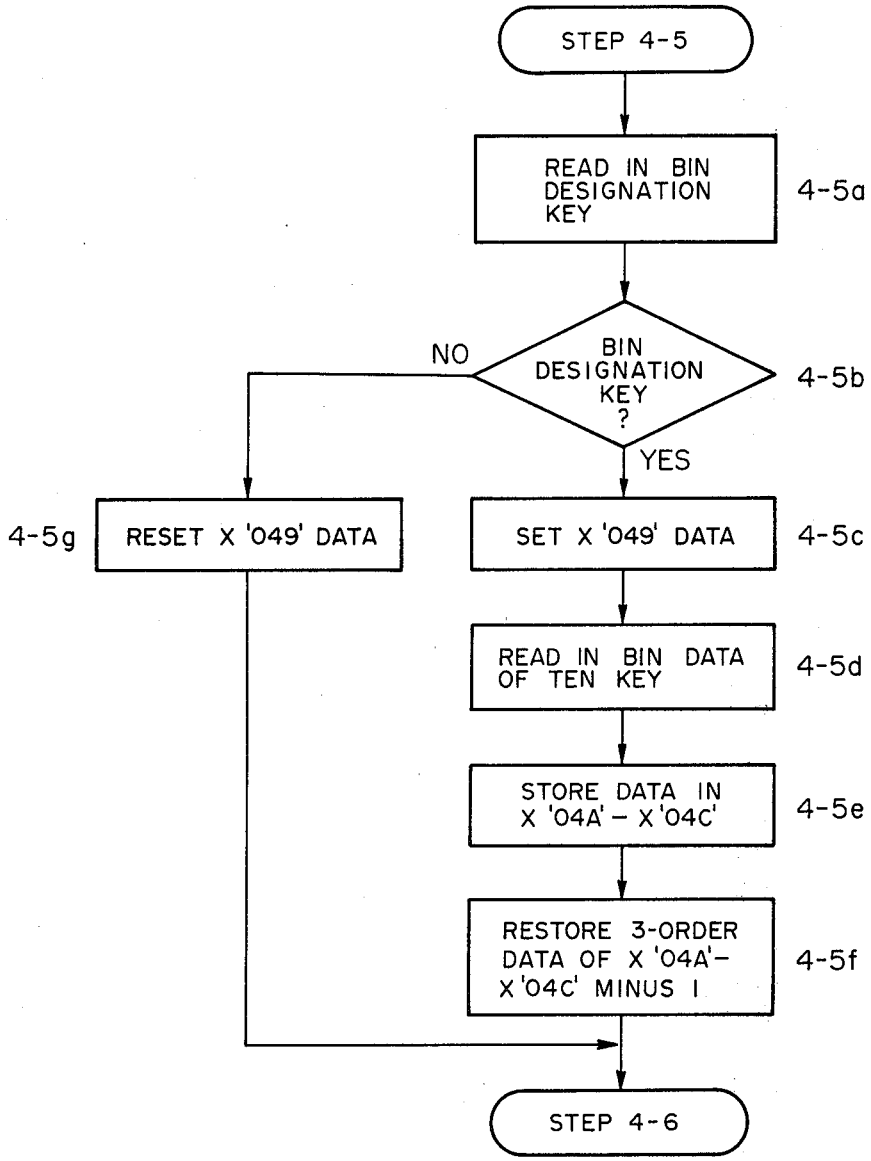
Figure 5:
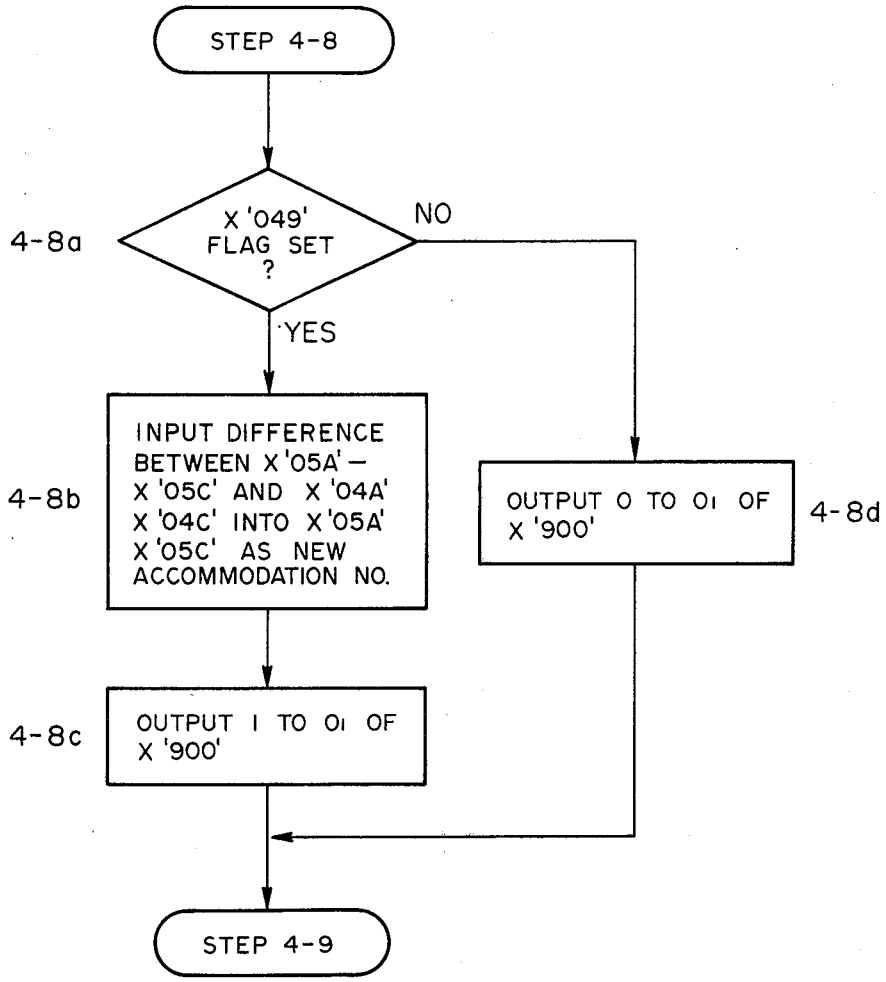

FIG. 5-1 is a control flow chart of the copying sequence stored in the read-only memory ROM. After the entry of bin number and key data (step 1), there is identified if the tray or sorter is selected (step 2) and outlet setting is performed in response to the detection whether the outlet is selected in the desired position (step 3). In case the sorter is selected, there is identified if the copying cycle is possible through the comparison of the bin number and the selected copy number (step 4), and the copying cycle is initiated in response to the copy start key actuation (step 5). Thus started is the motor for rotating the screen, insulating drum and other rotary members and chargers are energized to form the primary image on the screen (step 6), and, after the completion of said step, initiated is the repeat cycle of paper feed, formation, development and transfer of the secondary latent image (step 7, 8). When the number of repeated copying cycles reaches the selected copy number (step 9), the motor and high voltage supply are turned off to return to the initial key entry step (step 10).

Also in a sorting start bin selecting mode, the sequence shown in FIG. 5-2 is executed between the steps 5 and 6.

In this case there is detected the presence of the bin selecting flag X'049' (step 5-1), and, in the presence thereof, the pulses from X'04A'-X'04C' are supplied through the port O0 of X'900' at an interval of 0.5 seconds (step 5-2), said pulses being supplied as the bin drive signal to the sorter whereby claws a–k are shifted in succession as if the sheets are fed in succession. After reaching the claw k, the signals shift the claw 104 to the broken-lined position and also shift the claws of succeeding sorter in succession. Upon termination of said pulses the claws are shifted in response to the sheet feeding.

As an example of such control, FIGS. 3-4 shows a circuit provided in the sorter. The pulse signals S from the circuit shown in FIG. 3-3 are supplied through an OR gate 300 to a counter-decoder 301 for counting the number of sheets detected by the sensor 68*b*. Thus the counter-decoder 301 counts the number of pulses S to disable the claws of the bins located in front of the selected bin. Thereafter the decoder 301 controls the claws of the succeeding bins in response to the outputs from the sensor 68*b*, and cancels the data when the selected copy number is counted up or the storage into a determined bin is confirmed by the sensor 69*b*.

Now there will be explained the sequence shown in FIG. 5-3. In the entry step there are conducted the entry of the output selection key and the identification thereof. In the step 4-1 the matrix connected to the port I/ON is scanned by the signals T0–T5, and the input port KR3 receives the data from the sorter key and the tray key. CPU identifies if the high-level signal occurs at T4 or T5 (step 4-2), and respectively stores "0010" (sorter) or "0100" (tray) into the address X'032' in the memory RAM (step 4-3, 4-13). Then said data are supplied through the accumulator ACC to the output port of I/O800 (step 4-4). In case sorter selection the code "0010" is supplied in parallel through the data bus line DB, whereby the port O1 alone is set to light the sorter select lamp LS connected thereto.

Then identified is whether the conveyor belt 19 is set to the outlet to the sorter (step 4-5). Said identification is achieved by the state of a microswitch 67*b* detecting the position of the belt 19, said microswitch supplies a high-level signal to an appropriate bit of an unrepresented I/O port. Thus a code "0010" for sorter or "0100" for tray is stored in the address X'042' in the memory RAM. Said code in '042' is compared with that in '032' to confirm the sorter setting in case of said two codes mutually coincide. In the absence of coincidence the solenoid actuating data are supplied to determined I/O ports, and the obtained sorter set data "0010" are stored in the address X'042' in the memory RAM (steps 4-11, 4-12).

Subsequently the copy number entered by the ten numeral keys is stored in the addresses X'02A'-X'02C' in the same manner as explained in the foregoing (steps 4-6, 4-7). The total bin number in the sorters supplied through the connector 109 are stored through the input ports of I/O800 and I/O900 to the addresses X'05A'-X'05C' of the memory RAM (step 4-8). Then the selected copy number is compared with said bin number (step 4-9). If the former exceeds the latter, a high-level signal is set in the 4th bit of the address X'032' of RAM to supply the corresponding signal to I/O800 in the aforementioned manner (step 4-10), whereby the port O3 thereof releases a high-level signal to the gate 201 shown in FIG. 3-2. As said gate 201 also receives the pulses from the flicker circuit 200, said gate 201 generates a high-level signal for 1 second and a low-level signal for 0.5 seconds alternately. The gate 202 gives output signals corresponding to those from the gate 201 to intermittently light the sorter lamp LS. The copying cycle is not initiated in response to the copy start key as the CPU repeats the entry routine in the stand-by mode. On the other hand, if the selected copy number does not exceeds the bin number, the sequence proceeds to the copy start key identifying step to enable the copying cycle. Since said output port O3 is at the low-level state, the gate 201 releases high-level signal continuously to light the lamp LS continuously. Also in case the tray selection is detected in the step 4-2, there are executed the steps 4-13–4-17 in the similar manner as in the steps 4-3–4-7 for the sorter mode to enable the copying cycle.

It is also possible to prohibit the entry of a copy number exceeding the maximum bin number.

In case of the sorting start bin selecting mode, the sequences shown in FIGS. 5-4 and 5-5 are executed respectively between the steps 4-5 and 4-6 and between the steps 4-8 and 4-9 shown in FIG. 5-3.

In this sequence the bin selecting key is read (step 4-5*a*), and if it is a bin selecting key (step 4-5*b*) a flag is set in the address X'049' (step 4-5*c*). Then the bin selecting data from the ten numeral keys are read (step 4-5*d*) and stored in the addresses X'04A'-X'04C' (step 4-5*e*). For example in response to the actuation of keys "005", there are stored (X'04A)=0, (X'04B')=0 and (X'04C')=5. In order to start sheet storage from the 5th bin there is conducted a subtraction 005−1=004, and data restorage for X'04A'=0, X'04B'=0 and X'04C'=5 is conducted (step 4-5*f*). Said data conversion by subtraction is required for skipping four bins.

Thereafter executed are the above-explained steps 4-6–4-8, and the presence of a flag in the X'049' (step 4-8*a*). In the presence of said flag indicating the bin selecting mode, there is calculated the maximum number of sheets sortable in the sorter, said number being stored in X'05A'-X'05C' (step 4-8*b*).

The lamp LB is lighted by the output signal to the port O1 of X'900'. Thereafter executed are the steps 4-9–4-17 in the foregoing manner.

As the start bin and the end bin can be selected in the aforementioned manner, it is also possible to store all the sheets in a particular bin by selecting said bin as the start and end bins. Since the copy number can be selected higher than the maximum number of bins, it is also possible to collect all the overflowing sheets in the last bin.

What we claim is:

1. A copying apparatus, comprising:

a detachable sorter having plural storage bins;

means for detecting the number of usable bins of said sorter;

means for generating a detection signal representative of said number of usable bins in said sorter; and means for controlling the operation of said apparatus in response to the detection signal from said detecting means.

2. A copying apparatus according to claim 1, wherein said detecting means comprises:

a connector for transmitting the bin number signal from said signal generator to the main body of the copying apparatus.

3. A copying apparatus according to claim 2, wherein said detecting means further comprises:

means for adding the bin number signal from a succeeding sorter and that from a preceding sorter, said connector being adapted to transmit the additional signal thus obtained to the preceding sorter or the main body of the copying apparatus.

4. A copying apparatus according to claim 1, wherein said function control means is adapted to prohibit the copying operation when the number of usable bins detected by said detecting means is less than the desired copy number.

5. A copying apparatus according to claim 1, further comprises means for displaying sorter selection, said means being switched to a pre-determined display mode when the number of usable bins detected by said detecting means is less than the desired copy number.

6. A copying apparatus, comprising:

a detachable sorter having plural storage bins;

means for manually setting the number of usable bins in said sorter; and means for controlling the operation of said apparatus in response to the number of usable bins set by said setting means, said control means including:

means for setting a desired number of copies; and means for controlling the operation of said apparatus when the copy number set by said copy setting means exceeds the number of usable bins in said sorter set by said setting means.

7. A copying apparatus according to claim 6, wherein said setting means is enabled when said sorter is connected to the main body of the copying apparatus.

8. A copying apparatus according to claim 6, further comprising instructing means for enabling the use of said sorter.

9. A copying apparatus according to claim 6, wherein said setting means is adapted to set the last available bin.

10. A copying apparatus according to claim 9, wherein said operation control means is adapted to prohibit the copying operation when the number of usable bins set by said setting means is smaller than the desired copy number.

11. A copying apparatus according to claim 9, further comprising means for activating a display when the number of usable bins set by said setting means is smaller than the desired copy number.

12. A copying apparatus according to claim 6, wherein said setting means is adapted to select the sorting start bin.

13. A copying apparatus according to claim 12, wherein said operation control means is adapted to start storage of copy sheets from a selected bin.

14. A copying apparatus according to claim 12, wherein said operation control means is adapted to control said apparatus in response to the renewed storage capacity resulting from the selection of the sorting start bin.

15. A copying apparatus according to claim 12, wherein said operation control means is adapted to enable storage of copy sheets of a determined number in a determined bin set by said setting means.

16. A copying apparatus according to claim 12, wherein said means for controlling is adapted to activate a display in response to the detected renewed storage capacity resulting from the selection of the sorting start bin.

17. An image reproducing apparatus, comprising:

means for reproducing an image on a recording member;

sorting means having plural storage bins for storing recording members having a reproduced image thereon;

means for arbitrarily selecting a certain bin; and means for storing said recording members in succeeding bins up to said selected certain bin in said sorting means.

18. An image reproducing apparatus according to claim 17, wherein said storing means stores the recording members in succeeding bins up to said certain bin in said sorting means and remaining recording members in a separate position.

19. An image reproducing apparatus, comprising:

means for reproducing an image on a recording member;

sorting means connected to said reproduction means by a plurality of signal lines and having plural storage bins for recording members having a reproduced image thereon, said sorting means being provided with means for generating a coded signal indicative of a greater amount of data than the number of said signal lines; and means for controlling the operation of said image reproducing means in response to said coded signal.

20. An apparatus according to claim 19, wherein said codes signal indicates the storage capacity of said sorting means.

21. An apparatus according to claim 19, wherein said control means is adapted to prohibit the function of said image reproducing means.

22. A copying apparatus, comprising:

a detachable sorter having plural storage bins;

means for setting the maximum number of usable bins in said plural storage bins; and means for controlling the operation of said apparatus in response to the maximum number of bins set by said setting means.

23. An apparatus according to claim 22, wherein said setting means comprises means for selecting a start bin and means for selecting an end bin.

24. An image reproducing apparatus, comprising:

means for reproducing an image on a recording member;

sorting means having plural storage bins for recording members having a reproduced image thereon;

means for storing said recording members in succession to a certain bin in said sorting means; and means for arbitrarily setting said certain bin manually.

25. A copying apparatus, comprising:

a detachable sorter having plural storage bins;

means for detecting the storage capacity of said sorter and generating a detection signal in accordance therewith; and means for activating a display in response to the detection signal from said detecting means.

26. A copying apparatus according to claim 25, wherein said detecting means comprises:

a bin number signal generator provided on said sorter; and a connector for transmitting the bin number signal from said signal generator to the main body of the copying apparatus.

27. A copying apparatus according to claim 25, wherein said function control means is adapted to prohibit the copying operation when the storage capacity detected by said detecting means is less than the desired copy number.

28. A copying apparatus according to claim 25, further comprising means for displaying sorter selection, said means being switched to a predetermined display mode when the storage capacity detected by said detecting means is less than the desired copy number.

* * * * *

UNITED STATES PATENT AND TRADEMARK OFFICE

CERTIFICATE OF CORRECTION

PATENT NO. : 4,370,052

DATED : January 25, 1983

INVENTOR(S) : KATSUMI MURAKAMI, ET AL.

It is certified that error appears in the above-identified patent and that said Letters Patent is hereby corrected as shown below:

Column 3, line 28, "automobile" should read --automatic--.

Column 5, line 4, "bits" should read --bins--.

Column 10,line 32, "codes" should read --coded--.

Signed and Sealed this

*Twenty-third* Day of *August 1983*

[SEAL]

*Attest:*

GERALD J. MOSSINGHOFF

*Attesting Officer*

*Commissioner of Patents and Trademarks*